US005261389A

United States Patent [19]

Trieb

[11] Patent Number: 5,261,389

[45] Date of Patent: Nov. 16, 1993

[54] POWER VENT FOR HOT FLUE GAS

[75] Inventor: Jeffery S. Trieb, Brooklyn Center, Minn.

[73] Assignee: Tjernlund Products, Inc., White Bear Lake, Minn.

[21] Appl. No.: 929

[22] Filed: Jan. 6, 1993

Related U.S. Application Data

[63] Continuation of Ser. No. 589,378, Sep. 27, 1990, abandoned.

[51] Int. Cl.[5] ..... F23L 17/00

[52] U.S. Cl. ..... 126/85 B; 454/36

[58] Field of Search ..... 98/66.1, 78, 84; 110/162; 126/85 B, 307 R, 500

[56] References Cited

U.S. PATENT DOCUMENTS

| | | | |
|---|---|---|---|
| 2,462,383 | 2/1949 | Goodwin | 126/307 R X |
| 2,998,764 | 9/1961 | Bedell et al. | 126/85 B X |
| 4,200,038 | 4/1980 | Briner et al. | 98/84 |
| 4,765,308 | 8/1988 | Marran | 126/85 B |
| 4,934,335 | 6/1990 | Marlatt | 126/85 B |

FOREIGN PATENT DOCUMENTS

| | | | |
|---|---|---|---|
| 677365 | 1/1964 | Canada | 126/85 B |
| 2528350 | 7/1976 | Fed. Rep. of Germany | 126/85 B |
| 1283540 | 12/1961 | France | 126/85 B |
| 47-40003 | 10/1972 | Japan | 126/85 B |
| 723440 | 2/1955 | United Kingdom | 126/85 B |
| 1181652 | 2/1970 | United Kingdom | 126/85 B |

*Primary Examiner*—Harold Joyce

*Attorney, Agent, or Firm*—Patterson & Keough

[57] ABSTRACT

A power vent system is provided for exhausting hot combustion gas by-products. The system includes a plenum or mixing chamber, a conduit system and an air aspirating discharge assembly. Negative pressure is developed in the plenum by a blower therein; ambient air is drawn into the plenum from the atmosphere and mixed with the hot flue gases. The resulting cooled mixture is exhausted through the conduit system under pressure and, at the discharge assembly, additional ambient air is mixed with the mixture by a discharge assembly venturi effect which also accelerates the gases away from the discharge assembly.

15 Claims, 6 Drawing Sheets

POWER VENT FOR HOT FLUE GAS

This is a continuation of application Ser. No. 589,378, filed Sep. 27, 1990, abandoned.

TECHNICAL FIELD

The disclosed invention relates to venting or exhausting systems. In particular, it relates to a power venting system for exhausting hot combustion gases from the interior of buildings.

BACKGROUND OF THE INVENTION

Venting or exhausting combustion gases from fireplaces and, more recently, appliances having combustion chambers such as furnaces or water heaters typically is and has been accomplished by providing a vertically oriented chimney with a flue therein for convectively conducting hot combustion byproducts from the combustion chamber to the atmosphere.

In new construction, particularly in multi-unit buildings or townhouses, and in remodeling or adding new appliances to existing buildings, it is sometimes extremely difficult to provide the traditional vertically oriented chimney.

The result of the just stated problem was the development of venting systems for exhausting hot combustion gases horizontally as well as in the traditional vertical orientation. An example of this type of venting system is disclosed in U.S. Pat. No. 4,856,982.

With horizontal or through-wall venting systems typified by the system shown in U.S. Pat. No. 4,856,982, one problem is that heat tends to rise to the upper portion of the horizontal run and another problem is that the venting system frequently must penetrate a combustible wall. There have been attempts to address these problems. U.S. Pat. No. 4,765,308 suggests that a flue pipe may be provided with a number of sleeves having annuli therebetween whereby the flue pipe is isolated from the wall that it passes through. Additionally, convection is used to generate an air flow in and out of at least one of the spaces between the sleeves.

U.S. Pat. No. 4,765,308 also illustrates that through-wall or roof venting systems which enable or permit a flow of ambient air to enter the combustion chamber are well known. Convection has been used to generate flow of air or combustion gases in desired directions either into or out of a combustion chamber and to bring about a limited amount of cooling of the venting system. See U.S. Pat. Nos. 4,543,942, 4,750,433 and 4,757,802 disclosing other vent or insulated flue assemblies for through-wall, horizontal venting applications.

While the above cited patents represent improvements and advances for exhausting hot combustion gases horizontally through combustible materials, there are several problems which have remained unaddressed. First, there is the need to make absolutely sure that the hot exhaust gases are sufficiently cooled by the time they reach a combustible wall and that they are sufficiently cooled when exhausted or expelled from the exhaust system into the atmosphere. As long as hot combustion gas was being exhausted vertically, usually well above ground level, there was relatively little danger of burning people, pets or vegetation near the exhaust vent. When exhausting hot gases (initially at about 600 to 700 degrees Fahrenheit) at or near the ground, however, it is crucial that the temperature of the gas being blown out be reduced to a non-hazardous level.

Moreover, the vent apparatus or hardware at the building exterior must itself be cool enough to avoid burning a person or a child who might inadvertently touch it.

Other problems with through-wall venting systems include the accumulation of soot and other combustion byproducts near or around the vent or discharge opening at the outside of the building, and the formation of condensation as a result of the too rapid cooling of combustion gases. Additionally, ambient atmospheric conditions, high winds or severe cold, can cause problems with existing through-wall power vent systems, high back pressure or exacerbated condensation problems are but two examples. Thus, there remains a need for a safe, efficient inexpensive power venting system that substantially reduces the temperature of combustion gases prior to their discharge into the atmosphere, minimizes problems with condensation, and avoids staining the building at or near the discharge site.

SUMMARY OF THE INVENTION

The present invention provides for the horizontal, through combustible wall exhausting of hot flue orcombustion gas. The system consists of three basic components, a fan plenum, a conduit or flue system and a diffusing discharge. A negative pressure is produced in the plenum whereby ambient atmospheric air is drawn into the plenum for initial cooling. Additionally, the power vent system of the present invention provides for a second cooling of hot flue gas at or near the discharge of the system, as well as providing for the acceleration of the cooled gases away from the side of a building.

A feature of the present invention is a plenum or mixing chamber wherein a negative pressure is generated to draw ambient air into the plenum and mix it with the hot flue gas therein prior to moving the gas into a connected exhaust duct.

Another feature of the present invention is a discharge assembly, including a diffuser, for accelerating the cooled combustion gas as it leaves the discharge assembly, for providing another mixing of the gas and ambient air, for adjusting the flow rate of the gas and for improving the appearance of the system. It is an object of the present invention to provide a horizontal, through-wall power venting system, the portions of which located within a person's reach on the exterior of a building remain cool enough so that a person touching those portions will not be burned.

Yet another object of the present invention is to provide a thermal stabilizing power venting, through-wall exhaust system having a number of safety or "fail-safe" features associated therewith.

Other objects, features and advantages of the present invention will become more fully apparent and understood with reference to the following specification and to the appended drawings and claims.

DESCRIPTION OF THE PREFERRED EMBODIMENT

Figure 1:
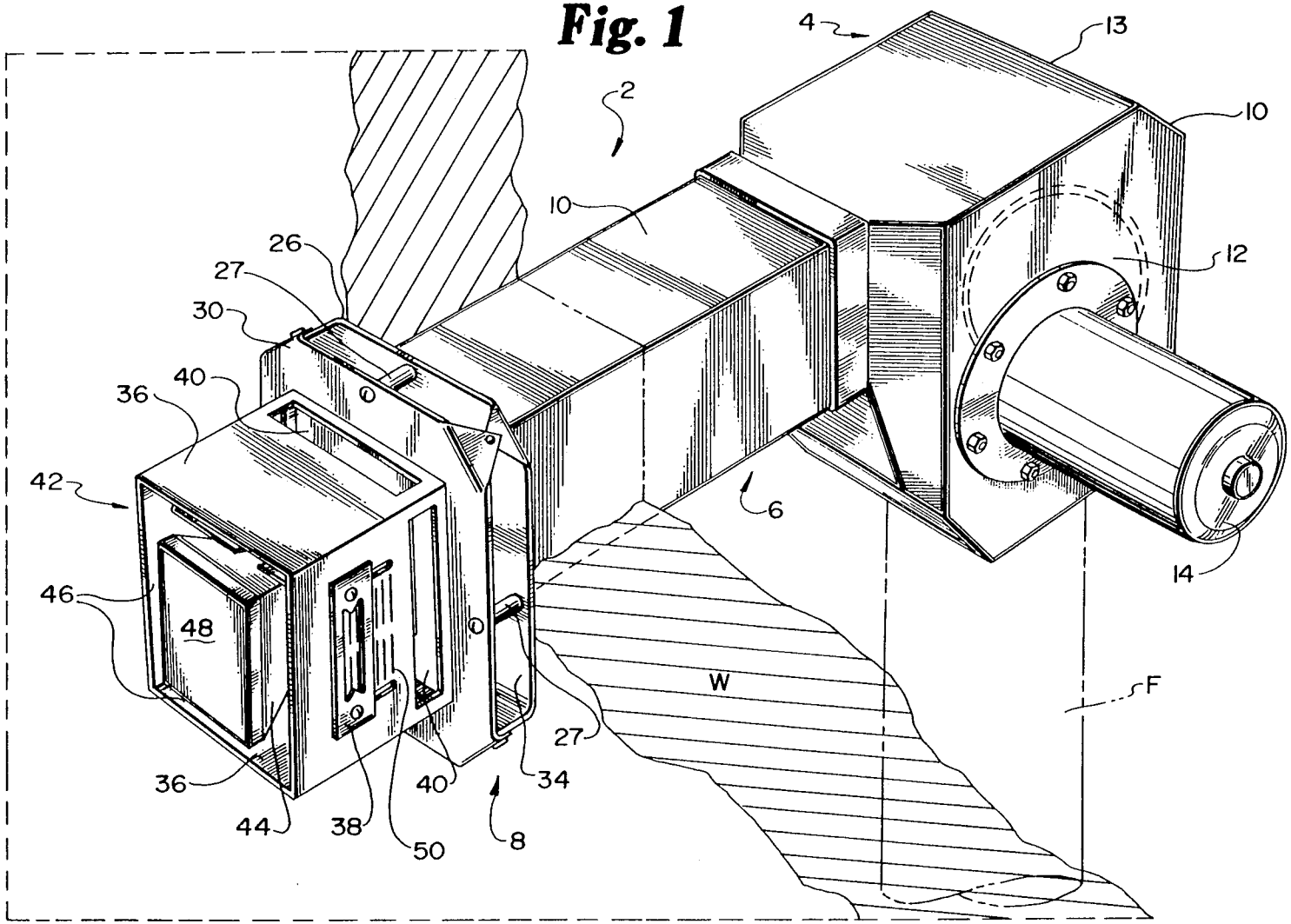
FIG. 1 is a perspective view of a power venting system in accordance with the present invention.

Referring to FIG. 1, the power venting system 2 of the present invention is shown extending through a wall W. The system 2 is made up of three basic subsystems or portions, a plenum 4, a duct housing or barrel 6, and a discharge assembly 8. A flue F is shown in phantom as it may be connected to the plenum 4.

Figure 2:
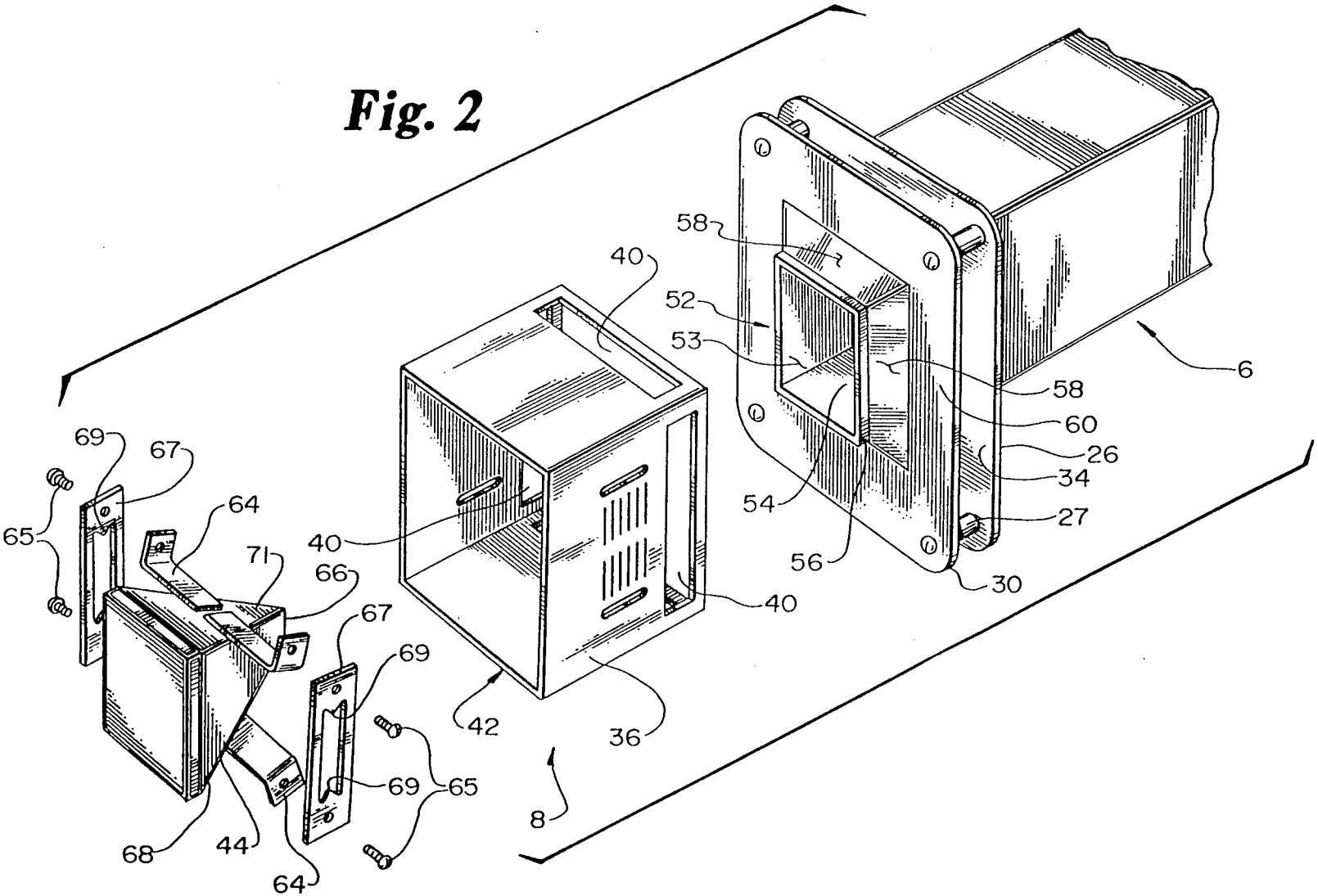
FIG. 2 is a fragmentary exploded perspective view of the duct housing portion of the power vent system.
Figure 2A:
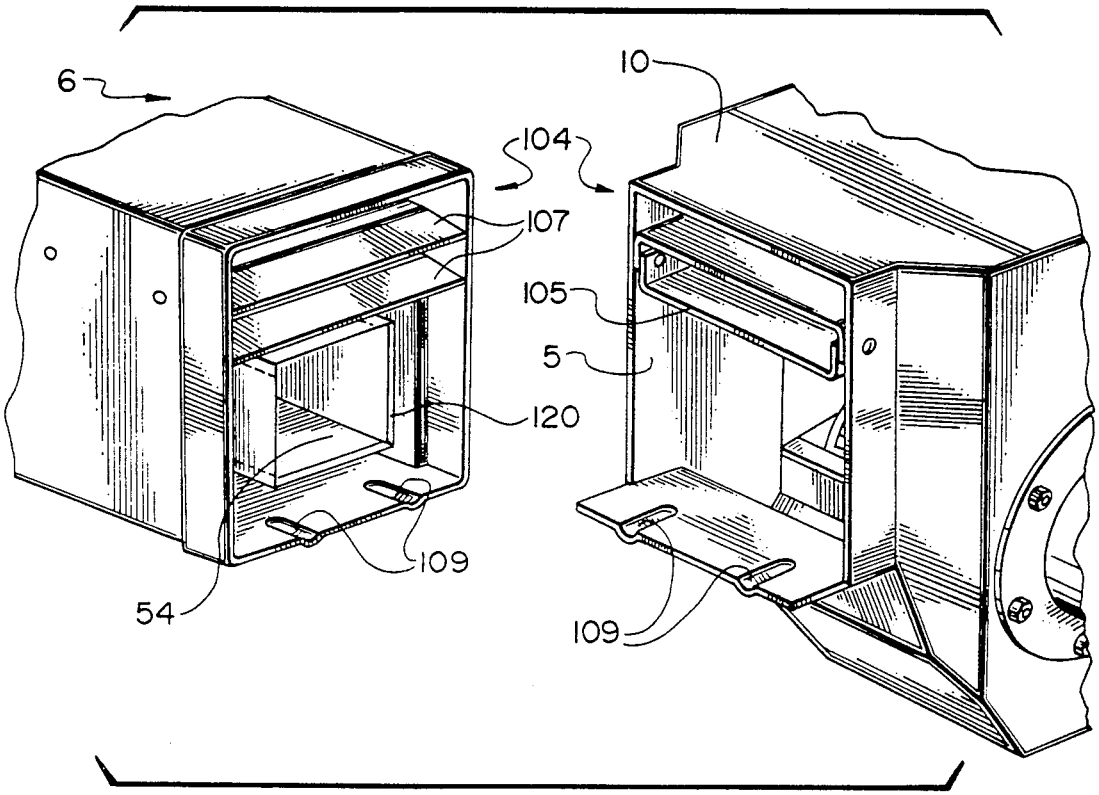
FIG. 2*a* is a fragmentary exploded perspective of the interior of the duct housing portion of the power vent system.
Figure 2B:
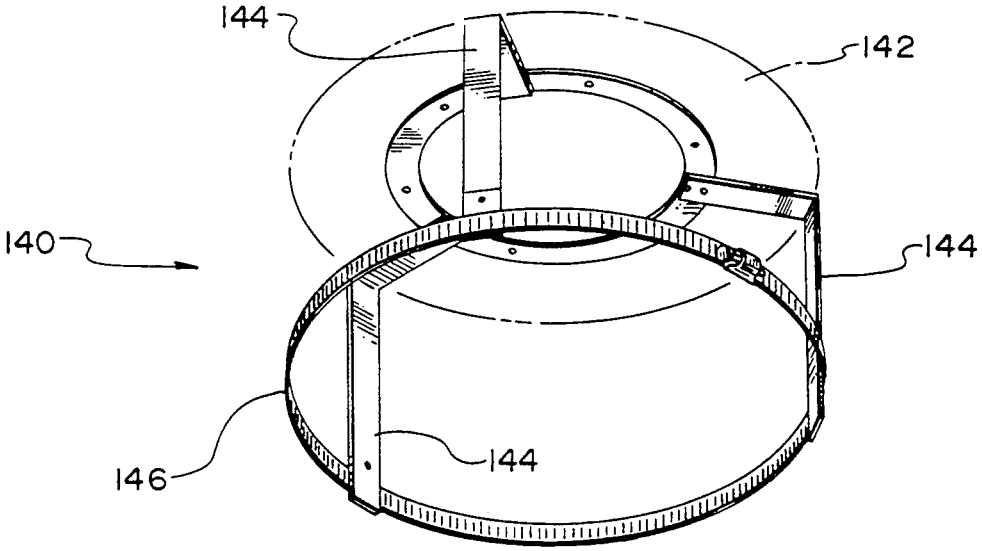
FIG. 2*b* is a perspective of an adaptor for coupling a flue to the plenum of the power vent system.

FIG. 2*b* shows an adaptor 140 for making the connection between the flue and the plenum. Specifically, the adaptor 140 enables the power vent system 2 to be used with any of the commercially available flue pipes such as single-wall, "A" or "B" pipes. The adaptor 140 includes an annular plenum plate 142, ribbon-like connective straps 144 and an adjustable tightening belt or collar 146. In use, the plenum plate 142 is mounted flush on a plenum wall or on a flange at the end of a vent pipe. The belt is then positioned on the flue pipe or sleeve therearound and tightened. Thus, the adaptor 140 ensures a solid, safe joint between the plenum and the flue pipe no matter what diameter pipe is used. Also, the adaptor provides a non-piercing way to couple vent pipes to the plenum 4.

Figure 3:
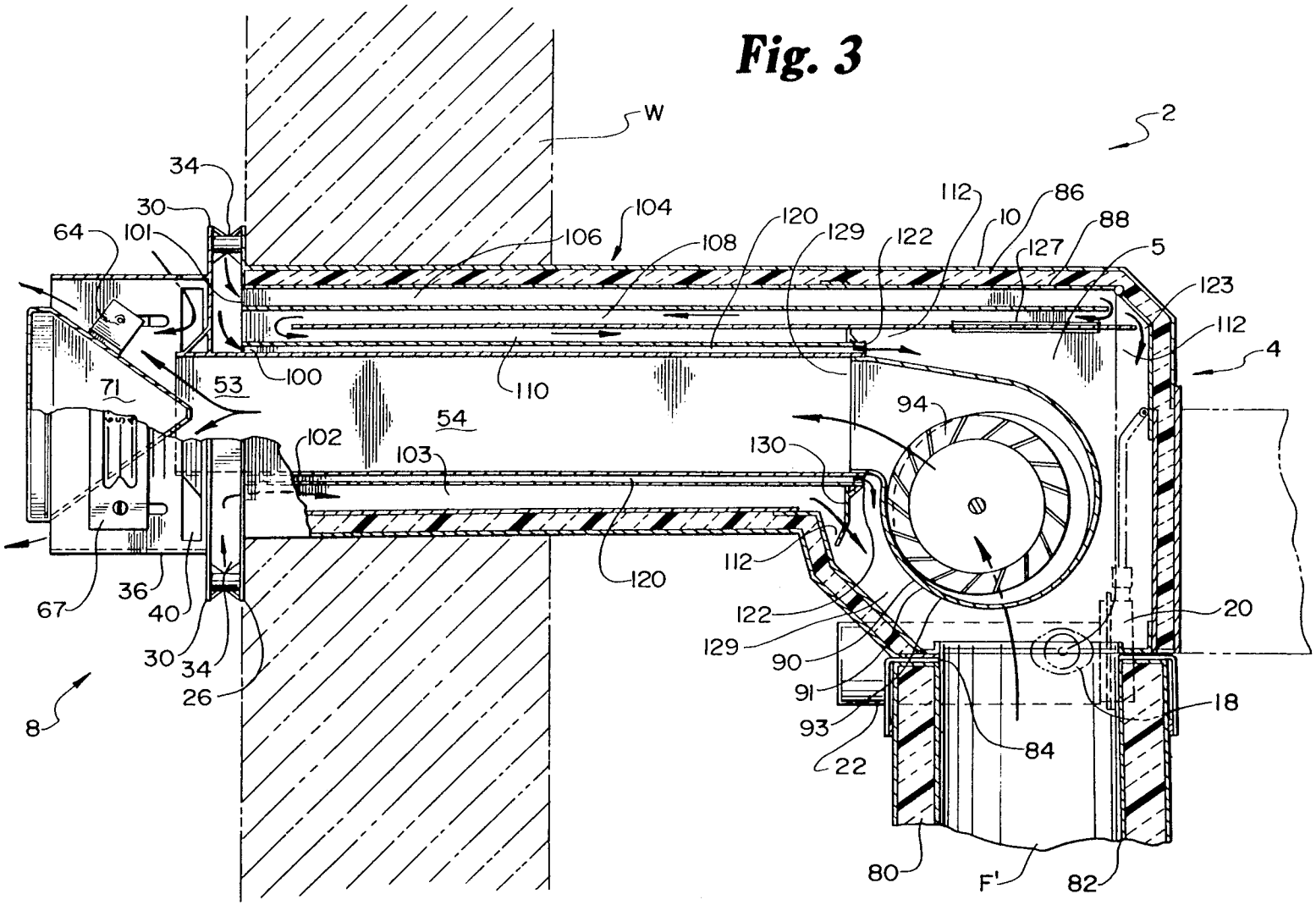
FIG. 3 is a left side elevational view of the present invention with portions cut away for clarity with air flow arrows indicating air paths through the system.

Returning to FIG. 1, the plenum 4 has an outer surface or skin 10 and includes a removable plate 12 whereby the flue F may be moved from the bottom of the plenum 4 to an optional connection location at the rear 13 of the plenum. A blower motor 14 is mounted on the outer surface of the plenum 4 and may extend through the plenum walls to drive an impeller or blower housed in the plenum 4 (see FIG. 3). Also depicted in FIG. 3 are a number of peripheral items mounted on or near the plenum 4: a failsafe sensor or switch 18 for high temperature control or for providing automatic shut down of an appliance if a set temperature is exceeded; barometric-type sensor 20 for monitoring pressure near the flue inlet of the plenum and/or the pressure in the conduit downstream of the plenum and various electronic control elements 22, for example, pre or post purge controls, may be provided as required.

The duct housing 6 has an outer surface or skin which broadly is a continuation of the outer surface 10 of the plenum 4. The duct housing 6 extends between the plenum chamber 4 and the discharge assembly 8 to provide for fluid communication therebetween.

The discharge assembly 8 comprises an exterior or external wall plate 26 for securing to the outside surface of a building. Four spacers 27 are provided for connecting a barrier shield 30 to the exterior wall plate 26. An air intake space 34 is provided between the plate 26 and the shield 30.

A diffuser 36 is connected to the barrier shield 30. The diffuser 36 has four walls 38 and each of the walls 38 is provided with an air intake slot 40. The slots are relatively closer to the barrier shield 30 than to the outward most end 42 of the diffuser 36. Although the diffuser 36 has a polygonal configuration it may also be formed as an open-ended cylinder or have a frusto-conical or frusto-prismatic shape (not shown).

Referring again to FIG. 1, the discharge assembly 8 is provided with a centrally mounted deflector 44 of similar or dissimilar geometry relative to the diffuser 36. The position of the deflector 44 within the discharge assembly provides a peripheral discharge opening 46 on all sides thereof. The deflector 44 is provided with a cover 48. Indicia 50 may be provided on the walls 38 of the diffuser 36 to indicate the position of the deflector 44 relative to the diffuser 36.

The outer surface or skin 10 of the power venting system may be formed of an appropriate gauge galvanized steel or aluminized steel; portions of the discharge assembly 8 may be formed of the same material, stainless steel or other material. It should be understood that the length of the duct housing 6 in FIG. 1 and in the following figures is representational only and that the duct housing 6 and other components of the present invention may be adapted for any installation.

FIG. 2 is an exploded perspective depiction of a portion of the system 2 of the present invention, particularly that portion which is exterior of or extends outwardly from or beyond the wall plate 26. Specifically, the open end 52 of the duct 54 is connected, through the plenum 4, to the combustion chamber (not shown). The duct 54 is peripherally wrapped by a primary heat shield which is conduit 120 (FIG. 3). Duct throat 53 leads to or ends at the open end 52, where an induction lip 56 is provided. On all sides of the induction lip a fillet 58 tapers outwardly and away from the lip 56. The fillet 58 terminates in an attachment portion 60 largely perpendicular to the sides of the duct 54 and attached to the barrier shield 30.

The diffuser 36 may be attached to the shield 30 by suitable means (not shown) and is positioned about the open end 52 whereby the slots 40 are in close proximity to and equally spaced from the open end 52 and the angled surfaces of the fillet 58.

The deflector 44 is attached in the diffuser 36 by at least one pair of slide brackets 64. Longitudinal adjustment of the deflector 44 within the diffuser 36 and with respect to the open end 52 of the duct 54 is enabled by loosening the fasteners 65 and repositioning the slide brackets 64 supporting the deflector 44. The external portion 67 of the bracket 64 may be provided with pointers or indicators 69 so the deflector 44 may be precisely positioned in the diffuser 36. The deflector 44 broadly comprises a pyramidal polygon or other proportionately progressive geometeries (not shown) having an apex 66 and base 68. The walls 71 taper outwardly at a constant or varying angle from the apex 66 toward the base 68, but the net angular projection angle may be varied to adjust flow rates and pressure to particular appliances or installations of the power vent system 2.

In FIG. 3 a double-walled flue F' is shown. The walls of the flue include a layer of insulation 80 and an additional lining 82. An adapter sleeve 84 is provided to make the connection to the plenum 4 of the present invention. It will be appreciated that the adapter 140 depicted in FIG. 2*b*, and described above, could be used in lieu of, or in conjunction with, the adapter sleeve 84. The plenum 4 also has a double-wall system comprising a layer of thermal insulation 86 and an inner skin 88, both of which are positioned inside the previously mentioned outer skin or surface 10. The thermal insulation 86 may be comprised of any suitable material, one example is a high density ceramic insulation.

The plenum 4 and the walls thereof comprise an interior cavity or chamber 5 for receiving gases from the flue F' and for housing a blower 90. The blower 90 is made up of a scroll housing 93 and a fan wheel 94. Any suitable material or construction may be used to form the fan or blower 90 as long as a negative pressure may be developed in the chamber 5. FIG. 3 makes it clear that the discharge of the blower 90 is directly into the duct 54 which, in turn, leads directly to the open end 52 at the exterior of the building. Thus, the blower 90 develops a negative pressure in the plenum chamber 5 along the external length of exhaust duct 54 and within the cavity of diffuser 36 adjacent to fillet 58, slots 40 and open end 52. An annular intake port 91 is provided on at least one side of the scroll housing 93.

Referring to FIG. 3, the exterior wall plate 26 provides for the air intake space 34 between the plate and the barrier shield 30. The wall plate 26 is provided with intake mouths, which may be of any appropriate array or shape, including, as depicted, an annular primary intake mouth 100 connected to intake conduit 120. The conduit 120 is provided with or terminates in an annular discharge port 122 open to the interior chamber 5 of the plenum 4.

The wall plate 26 also has an upper secondary intake 101 and a lower secondary intake 103. The upper intake 101 opens into a labyrinth series of passages 104, including an intake throat 106, a reverse throat 108 and a discharge passage 110. The discharge passage 110 is open to the interior of the plenum chamber 5 at openings 112. The labyrinth passages 104 provide a convoluted flow path between the ambient atmospheric air and the hot gases, at a negative pressure when the blower is operating, in the plenum chamber 5. The labyrinth passages 104 enable the gradual warming of the ambient air drawn therein and provide insulation.

Upper and lower secondary intake systems, including intakes, passages and ports 101, 103, 104, 110, 112, in addition to the primary annular intake system, including mouth 100, conduit 120 and port 122, provide air drops which promote initial cooling of the hot flue gases while those gases are still in the plenum chamber 5. The aforementioned discharge ports 122 and 112 as well as the upper rear port 123, upper opposite motor side port 127, opposite baffle port 129 (also see FIG. 5), and the lower front port, all inside the chamber 5, are strategically located to provide for optimal air circulation within the plenum chamber 5 while the blower is activated, thereby maintaining the plenum walls at as even and cool a temperature as possible.

FIG. 2*a* exemplifies how the labyrinth passages 104 and a duct housing 6 generally may be assembled or interlocked. It is important that the duct 54 and passages 104 of the present invention are made as continuous as possible with tight joints between the decks or walls 105 (only two shown) forming the passages. Therefore, angled areas 107 may be provided to produce a camming or sealing effect. Guides 109 are also provided to ensure accurate joints.

By mixing ambient and slightly warmed air, provided in the plenum by ports and openings 122, 112, the present invention provides for a plenum chamber 5 having walls that remain uniformly as cool as possible thereby minimizing "hot spots" on the exterior wall 10 of the plenum 4 and lessening the danger that combustible materials or persons touching the plenum will be burned.

Figure 5:
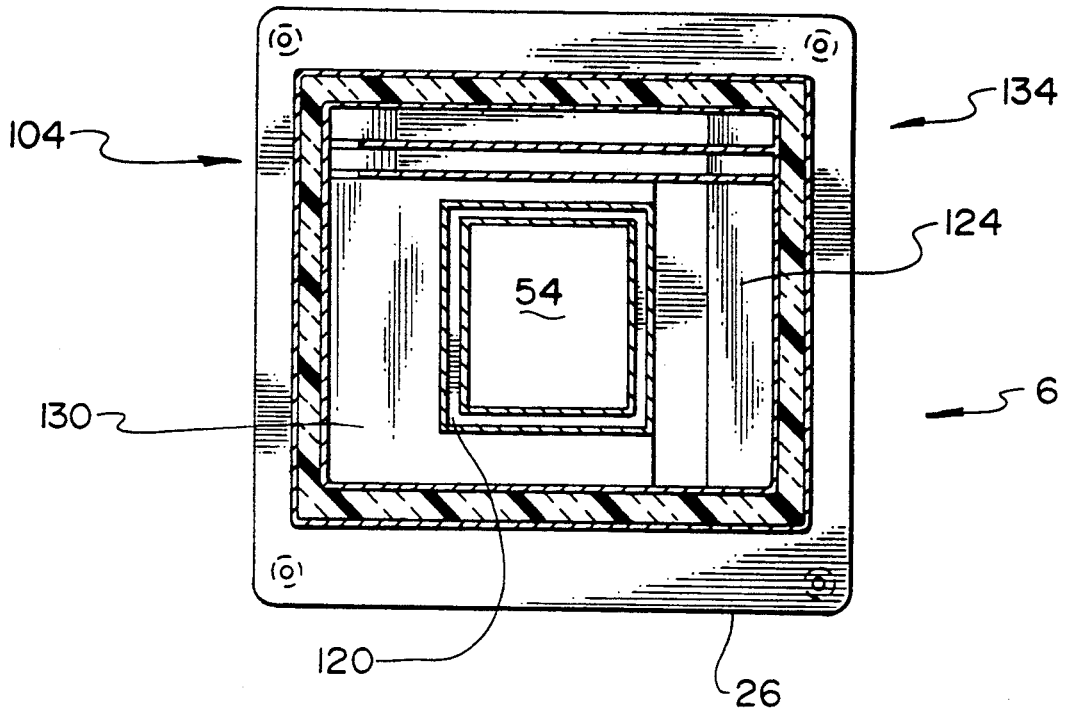
FIG. 5 is a sectional view taken along the line 5—5 of FIG. 4.

Referring to FIG. 5, it will be seen that the duct housing 6 is not concentric with respect to the duct 54. In particular, the upper portion of the duct housing 6 is deeper than the lower portion of the housing 6 to accommodate the labyrinth passages 104. The deeper ducting, and especially the labyrinth passages 104, provide for cooling and insulation with respect to the top of the duct housing 6.

Another feature of the present invention, and specifically of the plenum chamber 5, is the baffle plate 130. The plate 130 decreases or minimizes disproportionate drawing of cooler air through ports 122 immediately and directly toward the blower helping to keep the surface of the plenum as uniformly cool as possible. The mixing of hot flue gases, atmospheric air through the ports 122 and slightly warmed air through the openings 123, 125, 127, 129 in the plenum chamber 5, gives rise to an "air shower" or flow of ambient or slightly warmed air in the chamber whereby an effective mixing takes place for initial cooling of the hot exhaust gas. The lateral location of the intake port 91 of the fan housing 93 further blends the mix of primary and secondary duct air produced by the baffle 130 with hot flue gas entering the plenum chamber 5 and contributes to the even distribution of heat within the chamber.

The initial cooling of flue gases within the plenum 5 reduces the gas temperature from beyond 700° F. to approximately 400° to 500° F. Further cooling is accomplished by the diffuser 36.

Figure 4:
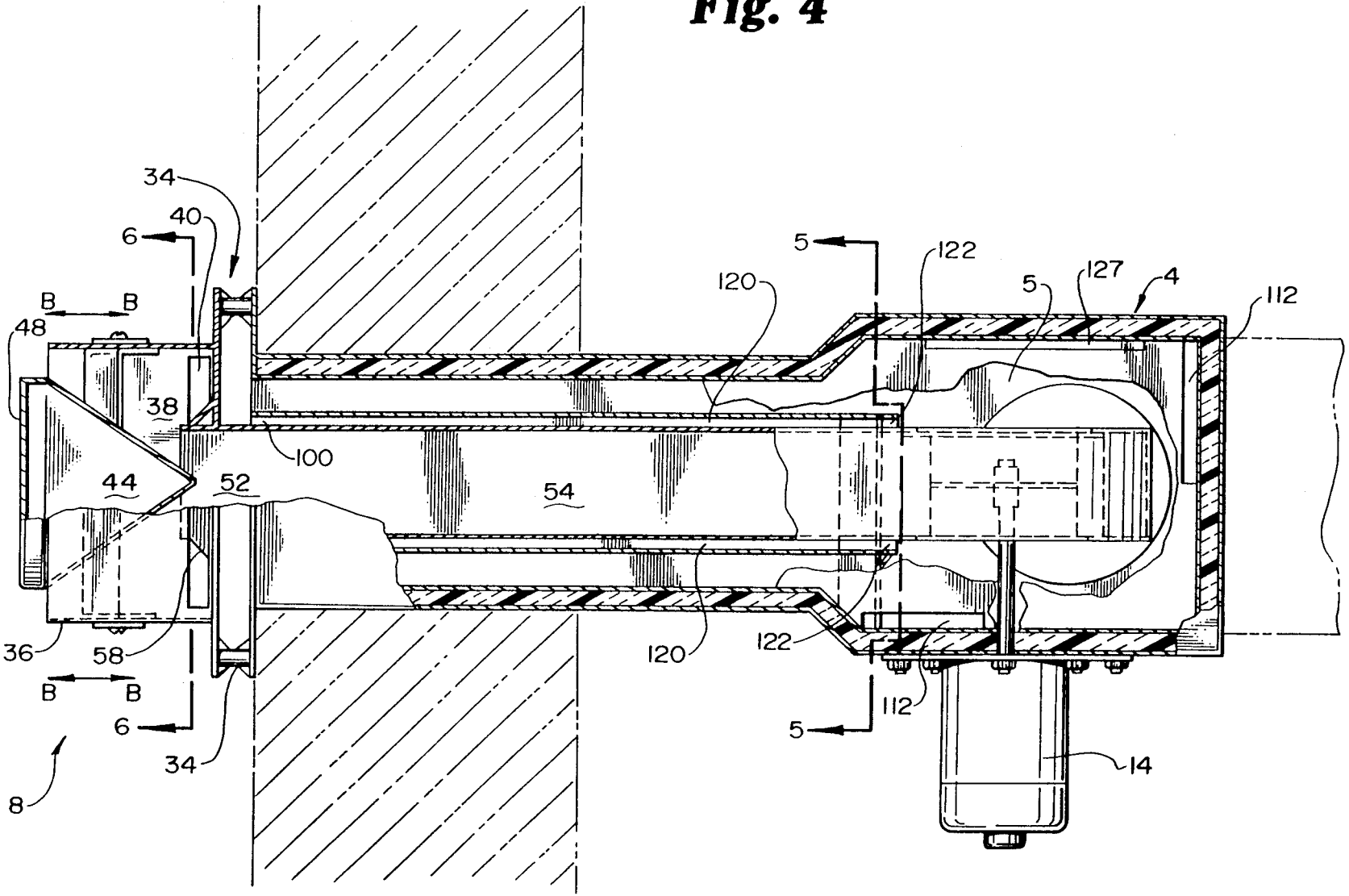
FIG. 4 is a top plan view of the present invention with portions cut away for clarity.
Figure 6:
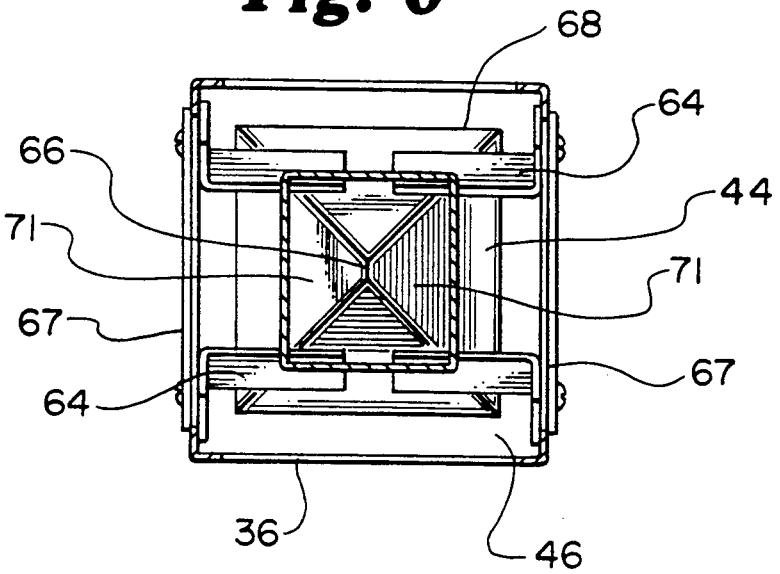
FIG. 6 is a sectional view taken along the line 6—6 of FIG. 4.

In particular, FIGS. 4, 5 and 6 illustrate that the air intake slots 40 and the walls 38 of the diffuser 36 are positioned such that a venturi effect is induced by the deflector 44 and the throat 53 to draw ambient air inwardly through the slots 40. The effect is augmented by the fillet 58 at the end of the duct 54. The introduction of ambient air inwardly through the slots 40 cools the hot gases to approximately 300°–400° F. compared to the initial flue temperature which is beyond 700° F.

Cooling is developed by a venturi effect as air flow accelerated through throat 53. The temperature as the gas mixture is being discharged beyond opening 46 may be reduced to less than 200° F. In addition, the acceleration of the gas, a result of the venturi effect causing aspiration through slots 40 at the diffuser 36, causes a dramatic reduction in the concentration of unburned combustion materials and soot. Further, the chance for condensation to occur is reduced for at least two reasons. First, the significant quantity of outdoor or ambient air which is a component of the final gas mixture effectively lowers the dew point temperature of that mixture. Secondly, the quantity of ambient air is limited or controlled to maximize the input rating which also maintains the ultimate mixture temperatures at levels which are greater than the associated dew point temperature.

Referring to FIG. 4, at the opposite end of the duct 54, the deflector 44 may be selectively positioned in the diffuser 36 with respect to the open end 52 of the duct 54. The adjustment of the deflector 44 (along arrow B—B) allows the draft to be adjusted to the fuel, burner type, length of vent pipe, input capacity of the appliance, opposing wind load and building envelope pressure. In particular, moving the deflector 44 inwardly toward the end 52 or throat 53 of the duct 54 increases the pressure in the duct and outward movement will reduce the pressure, whereby volume and rate of exhaust gas flow may be adjusted.

The non-concentric arrangement of the duct 54 within the duct housing 6, as depicted in FIG. 5, provides significant thermal resistance where needed, that is, at the upper portion 134 of the duct housing 6. Moreover, as ambient air is drawn into the intake mouth 101 and circulated through the intake throat 106, the reverse throat 108 and finally into the intake discharge passage 110, it is gradually warmed by its increasing proximity to the duct 54 through which the hot gases are flowing. Referring again to FIG. 5, the duct 54 conducting the hot gases to the exterior and the duct housing 6 is well insulated on all sides by primary intake conduit 120, which also functions as a thermal radiation shield.

The power venting system of the present invention may take different forms within the scope of the invention. In certain embodiments, the duct housing 6, the duct 54 and portions of the discharge assembly 8 may be cylindrical or any geometric orientation; peripheral items such as additional sensors or warning indicators for fan malfunction, overheating or appliance malfunction may be provided; a pressure modulator/transceiver may be provided to sense ambient conditions (e.g., wind gusts) or appliance draft/hearth pressures and to vary the blower motor speed or adjust the deflector 44 inwardly or outwardly accordingly; a timed post-purge feature may be incorporated; the material for forming the duct work, the plenum 4 and the discharge assembly 8 may be selected from appropriate materials; various securing means other than friction fit may be used to attach components and to secure the power vent system in place. Additionally, various indicia or instructions for function and assembly may be provided on the exterior surfaces of the system 2.

In operation, upon a call for heat, the blower 90 will start, pulling combustion gases from the flue F connected to an appliance into the plenum 4. Simultaneously, the lower pressure in the plenum acts to pull ambient, outside air into the air inlets 100, 102, 101, 103, through the vent housing 6 surrounding the duct 54, including the labyrinth passages 104, and into the plenum chamber 5. This provides for insulating the duct 54 from the combustible wall and for the mixing of cooler air with hot combustion gases in the plenum chamber 5. Prior to exiting the discharge assembly 8, the cooled, mixed air/combustion gas mixture is again diluted and cooled by the aspiration generated by the deflector 44 and open end 52. When the demand for heat is satisfied and the appliance is off, an adjustable timed post-purge feature may clear the system 2 of combustion gases.

It will be seen that a cost effective, safe and efficient method of exhausting hot combustion gas through combustible walls or other structures is provided by the power system 2. The invention may be easily installed in existing buildings or it may be used in new construction.

The present invention may be embodied in other specific forms without departing from the spirit or essential attributes thereof, and it is therefore desired that the present embodiment may be considered in all respects as illustrative and not restrictive, reference being made to the appended claims rather than to the foregoing description to indicate the scope of the invention.

I claim:

1. A venting system for exhausting hot gases to the atmosphere from a flue connected to a combustion chamber within an interior space, said system comprising:

a plenum having structure defining a first inlet, a second inlet, and an outlet, the first inlet adapted for operable coupling to the flue for receiving said hot gases;

cold air conduit means for conducting cold air from outside said interior space to said plenum, having an interior end operably coupled to said second plenum inlet and an external end outside said interior space, said second inlet being spaced apart from said first inlet such that said cold air is introduced into said plenum independently from said hot gases whereby said cold air and said hot gases are initially mixed within said plenum for cooling of said hot gases;

a mixed gas conduit operably coupled to said plenum outlet and extending beyond said interior space for conducting said hot gases mixed with said cold air from said plenum to outside said interior space, said mixed gas conduit having an internal end operably coupled to said plenum outlet and an external end outside said interior space, said mixed gas conduit being received within said cold air conduit whereby the cold air in said cold air conduit acts to cool said mixed gas conduit;

fan means operably coupled to said plenum for drawing said hot gases and said cold air into said plenum, mixing said hot gases and said cold air in said plenum and discharging the mixed gases and cold air through the mixed gas conduit;

discharge means operably coupled to said external end of said mixed gas conduit for cooling the hot gases as the gases are discharged from said conduit to the atmosphere, said discharge means including structure defining a mixing chamber and means for introducing ambient air into said mixing chamber for mixing of said ambient air with said hot gases prior to discharge of said gas from said discharge means, said mixing chamber being operably coupled to said external end of said conduit for receiving said gases as the gases exit said conduit, said means for introducing ambient air into said mixing chamber comprising structure defining ventilation apertures for introducing ambient air into said mixing chamber; and deflector means receivable within said mixing chamber for reducing the cross sectional area of said mixing chamber and thereby accelerating the flow of said gases as the gases pass through said discharge means and drawing said ambient air throughout said ventilation apertures.

2. The apparatus as claimed in claim 1, including adjusting means operably mounting said deflector means within said mixing chamber for selectively adjusting the position of said deflector means within said mixing chamber whereby the amount of said reduction of said cross sectional area can be selectively adjusted.

3. The apparatus as claimed in claim 1, said deflector means presenting a proportionately progressive geometric shape.

4. The apparatus as claimed in claim 3, said deflector means presenting a pyramidal polygon shape having an apex end internally received within said mixing chamber and an externally facing base end.

5. A power vent system comprising:

a flue gas collection means for collecting hot flue gas; and a vent assembly operably coupled to said collection means comprising a means for inducing negative pressure in said collection means, an insulated flue gas conduit having a first end opening coupled to said collection means and an opposed second end and a discharge means operably coupled to said conduit second end for cooling and accelerating said flue gas into the atmosphere, said flue gas conduit further comprising an inner duct extending between said collection means and the atmosphere, said duct being eccentrically surrounded by at least one passage forming a flow path for introduction of ambient air into said collection means, said conduit comprising a barrel having an interior and exterior, said exterior adapted for direct contact with combustible materials, said interior including said duct, said duct having a first end connected to said collection means and a second end open to the atmosphere, said duct being positioned eccentrically within said barrel, such that the space between the barrel and the duct is greater on the upper side of the duct than on the lower side of the duct, said upper side space having a plurality of passages extending between said collection means and the atmosphere whereby ambient air may flow through said passages and into said collection means.

6. The apparatus as claimed in claim 5, said passages comprising a labyrinth series of passages including an intake passage, reverse passage and discharge passage operably coupled together in fluid communicating relationship.

7. The apparatus as claimed in claim 6, said flue gas collection means including a baffle plate operably positioned therein for selectively restricting the flow of ambient air through said lower side space into said collection means.

8. A venting system for exhausting hot gases to the outside atmosphere from a flue connected to a combustion chamber located in an interior space, said venting system comprising:

(a) a plenum having a first inlet connected to said flue for receiving only said hot gases;

one or more second inlets separate from said first inlet for receiving only outside air from outside said interior space; and an outlet;

(b) a fan means disposed within said plenum for drawing said hot gases and said outside air into said plenum through said first and second inlets, respectively, mixing said hot gases and said outside air within said plenum to produce an air mixture cooler than said hot gases, and discharging said air mixture through said outlet;

(c) a duct assembly connected to said plenum including:

one or more intake conduits connected to said one or more second inlets for passing said outside air to said plenum; and an exhaust conduit internal to and surrounded by said one or more intake conduits and connected to said outlet for passing said air mixture to said outside atmosphere such that said air mixture is further cooled while said air mixture is passing through said exhaust conduit; and (d) a discharge means located outside of said interior space and connected to said duct assembly for still further cooling said air mixture as it is discharged from said exhaust conduit through said discharge means to the outside atmosphere, said discharge means including:

structure defining a mixing chamber;

ventilation means for introducing further outside air into said mixing chamber for mixing said further outside air with said air mixture to create an intermixed air mixture before discharging said intermixed air mixture into the outside atmosphere; and deflector means positioned within said mixing chamber for reducing a cross sectional area of said mixing chamber perpendicular to the flow of said intermixed air mixture, thereby accelerating the flow of said intermixed air mixture as said intermixed air mixture passes through said discharge means and drawing said further outside air through said ventilation means.

9. The venting system of claim 8 wherein said discharge means further includes:

adjusting means operably mounting said deflector means within said mixing chamber for selectively adjusting the position of said deflector means within said mixing chamber, whereby the amount of reducing of said cross sectional area can be selectively adjusted.

10. The venting system of claim 8 wherein said one or more intake conduits comprise a barrel having an interior and an exterior, said exterior adapted for direct contact with combustible materials, said exhaust conduit being positioned eccentrically within said barrel such that an upper side space in said barrel above said exhaust conduit is greater than a lower side space in said barrel below said exhaust conduit.

11. The venting system of claim 10 wherein said interior of said barrel includes a plurality of walls forming a plurality of passages in said upper side space whereby said outside air may flow through said passages and to said one or more second inlets.

12. The venting system of claim 11 wherein said passages comprise a labyrinth series of passages including an intake passage, reverse passage and discharge passage operably coupled together in fluid communicating relationship.

13. The venting system of claim 10 wherein said barrel include a baffle plate operably positioned therein for selectively restricting the flow of said outside air through said lower side space.

14. The venting system of claim 8 wherein said deflector means presents a proportionately progressive geometric shape to said cross sectional area.

15. The venting system of claim 14 wherein said deflector means presents a pyramidal polygon shape having an apex end internally received within said mixing chamber and an externally facing base end.

* * * * *